US005752728A

United States Patent [19]

Matouschek

[11] Patent Number: 5,752,728

[45] Date of Patent: May 19, 1998

[54] ALARM-TRIGGERING LOCKING DEVICE FOR THE CATCH AND/OR HINGE REGION OF A DOOR OR WINDOW TO BE PROTECTED

[76] Inventor: Erich Matouschek, Schwalbenweg 16, 72584 Hulben, Germany

[21] Appl. No.: 693,194

[22] PCT Filed: Nov. 16, 1994

[86] PCT No.: PCT/EP94/03796

§ 371 Date: Aug. 13, 1996

§ 102(e) Date: Aug. 12, 1996

[87] PCT Pub. No.: WO95/21980

PCT Pub. Date: Aug. 17, 1995

[30] Foreign Application Priority Data

Feb. 12, 1994 [DE] Germany ..... 44 04 548.4

[51] Int. Cl.[6] ..... E05B 15/02

[52] U.S. Cl. ..... 292/340; 292/346; 340/542; 340/545

[58] Field of Search ..... 292/340, 346, 292/341, DIG. 65; 340/542, 545

[56] References Cited

U.S. PATENT DOCUMENTS

| | | | |
|---|---|---|---|
| 3,704,460 | 11/1972 | Frank . | |
| 3,978,467 | 8/1976 | Albert | 340/545 X |
| 4,390,867 | 6/1983 | Queren | 292/346 X |
| 5,257,841 | 11/1993 | Geringer et al. | 292/340 |

FOREIGN PATENT DOCUMENTS

| | | | |
|---|---|---|---|
| 0 293 952 | 12/1988 | European Pat. Off. . | |
| 877 083 | 11/1942 | France . | |
| 986 647 | 8/1951 | France . | |
| 2448609 | 10/1980 | France | 340/542 |
| 395910 | 7/1933 | United Kingdom | 292/340 |
| 2 083 858 | 3/1982 | United Kingdom . | |

*Primary Examiner*—Rodney M. Lindsey
*Attorney, Agent, or Firm*—Browdy and Neimark

[57] ABSTRACT

An alarm-triggering locking mechanism for the lock and/or hinge area of a door to be secured or a window to be secured is proposed, which is embodied as a locking plate (23) which can be attached to a door or window frame by means of holding screws (27) embodied as the first blocking device. A second blocking device, which is harder to overcome by the effect of force, is embodied as at least one striker element (25) rigidly connected with the locking plate (23) and which, following the limited movement of the locking plate (23) in the opening direction, comes to rest against a counter-striker element (26) anchored on the door or window frame. An alarm, in particular a silent alarm, is triggered via radio or the telephone net after the first blocking device has been overcome. The burglar is thereafter delayed by the second blocking device, which makes it possible for security forces to reach the location of the break-in and to arrest the burglar while the break-in is still in progress.

13 Claims, 6 Drawing Sheets

Figure 1:
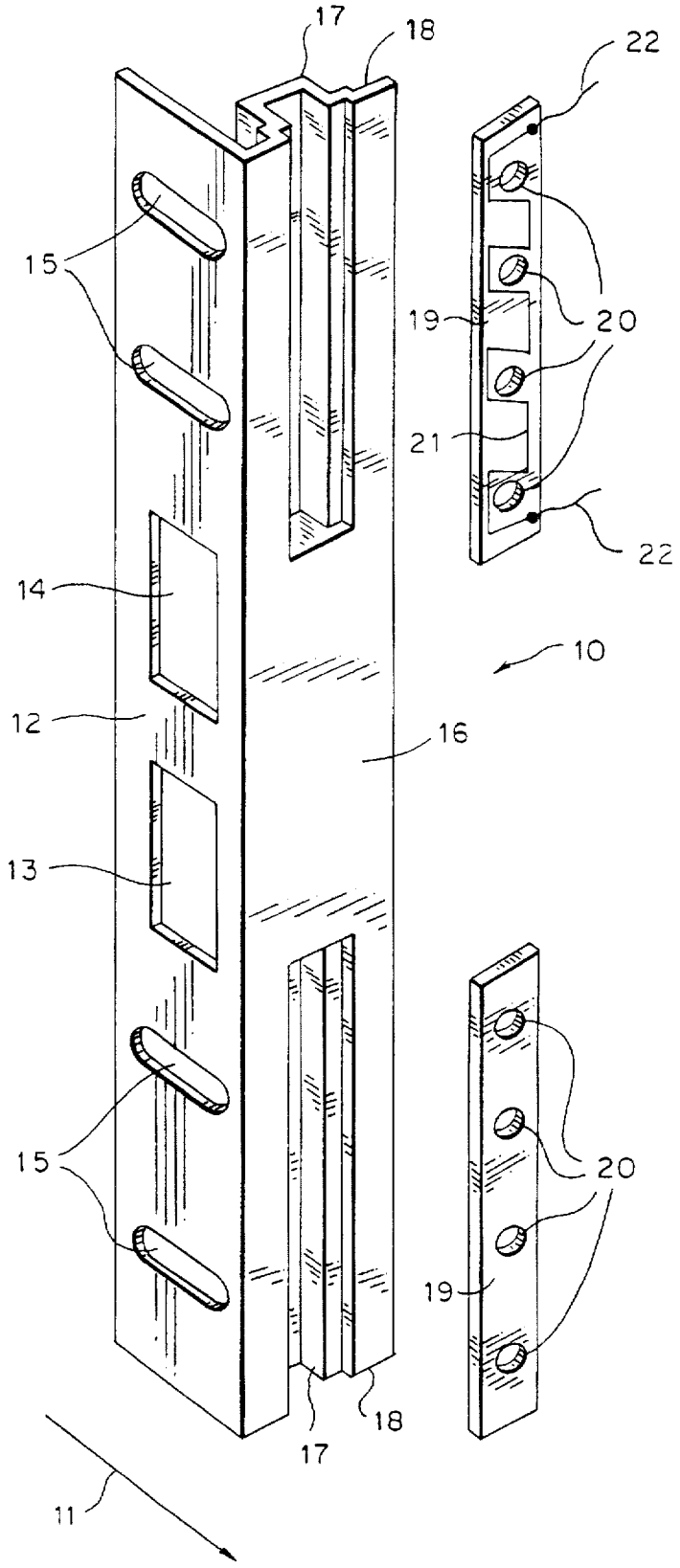

ALARM-TRIGGERING LOCKING DEVICE FOR THE CATCH AND/OR HINGE REGION OF A DOOR OR WINDOW TO BE PROTECTED

SPECIFICATION

The invention relates to an alarm-triggering locking mechanism for the lock and/or hinge area of a door to be secured or a window to be secured, with a first blocking device for the locking mechanism, which must be overcome by the application of force, with a second blocking device for the locking mechanism, which is harder to overcome by the effect of force, and with means which trigger an alarm when the first blocking device is overcome, wherein, after the first blocking device has been overcome, the movement of the locking mechanism in the direction of opening of the door or the window is limited by the second blocking device.

The basic mode of functioning of this locking mechanism is known from DE 42 21 585 A1 and consists in that, in case of a break-in, the first blocking device is initially overcome by force, in the process of which an alarm is triggered. This is preferably the triggering of a silent alarm by means of which the breaking open is reported to an alarm center. However, after triggering the alarm, the burglar is now prevented from entering the building by the second blocking device, which offers a greater resistance in comparison with the first blocking device. It is now necessary for him to make greater exertions to overcome this second blocking device, too, wherein the time required for this gives the support personnel or the police an opportunity to reach the location of the break-in.

The known locking device is embodied as an additional security element, which entails an additional outlay in material and expenses during manufacture and installation. Further than that, the installation of this additional security device in a visually neutral and unobtrusive way presents problems.

An object of the instant invention is to provide an alarm-triggering locking mechanism of the species mentioned at the outset which is easier to install and can replace a conventional locking plate in a lock and/or hinge area in a simple way.

This object is attained in accordance with the invention in that the locking mechanism has a locking plate which can be attached to a door or window frame by means of securing screws or bolts embodied as the first blocking device, and that the second blocking device is embodied as at least one striker element, which is rigidly connected or connectible with the locking plate or the wing of the door or window and which, following a limited movement of the locking plate in the opening direction, comes to rest on at least one counter-striker element anchored on the door or window frame.

Since the locking mechanism in accordance with the invention is embodied as a locking plate, it can be used in a simple manner in place of a known locking plate and is therefore also suited for retrofitting. The locking plate in accordance with the invention can be realized without problems in the shape of known locking plates, in particular in the form of locking plates with an L-shaped cross section in the locking area of a door or a window or of locking plates in the hinge area. A burglar will not notice that a safety alarm has been installed when breaking open a door or window, particularly if it has been provided as a silent alarm system, i.e., when overcoming the first blocking device a radio or telephone alarm is forwarded to a security company manned around the clock. If, after overcoming the first blocking device, the burglar encounters the second blocking device, he will either already give up the attempt, or it will be possible to catch him red-handed and arrest him, since he is delayed by the second blocking device after triggering the alarm. Thus, in general he can be arrested even before he enters the building. The deterrent success based on this type of security should have a long-term preventive effect, which should lead to a considerable damage reduction. The additional financial and installation outlay for attaching the locking plates in accordance with the invention, in particular in connection with already installed alarm systems with a silent alarm, is relatively small.

Advantageous further developments and improvements of the locking mechanism recited in claim 1 are possible by means of the steps listed in the dependent claims.

In a preferred embodiment, the striker element is embodied in the form of at least one striker strip disposed spaced apart from the locking plate in the opening direction, and the screw heads of holding screws penetrating the striker strip are embodied as counter-striker elements, wherein in the original installation state of the locking plate the screw heads are arranged spaced apart from the striker strip. In this case the striker strip usefully is formed in one piece on the locking plate and has an essentially U-shaped cross section. By means of the length of the locking plate and the number of the holding screws or screw heads it is possible to practically arbitrarily select the force of the resistance of the second blocking device against break-in attempts without a considerable additional outlay being required.

In connection with such an embodiment it is in addition possible in an alternative that the holding screws, which are also embodied as first blocking device, penetrate at least one small holding plate used as a predetermined breaking element which, in the original installed state, is held on the locking plate by means of the holding screws, wherein, following the breaking of the small holding plate and a movement of the locking plate in the opening direction, the screw heads move through the latter to the striker strip. In this case the at least one small holding plate is usefully embodied to be inserted into the locking plate and is prevented from moving in the direction of the striker strip by means of a stop. It is possible here to set the resistance to a break-in attempt of the first blocking device by the selection of the small holding plate. It is furthermore possible in an advantageous manner to place an alarm wire in or on this small plate, which tears when the small holding plate breaks and in this way triggers the alarm.

In a second alternative the screw heads which penetrate through the striker strip are disposed in the original installed state essentially flush in openings of the locking plate which have at least the diameter of the screw heads, wherein the screw heads of the holding screws embodied as the first blocking device rest against the locking plate or are countersunk in the form of flat head screws. In this embodiment it is possible to design the locking plate particularly simply and cost-effectively, i.e. it is only necessary to form or weld the connecting strip of a preferably U-shaped cross section and otherwise it is only necessary to drill the various holes.

A further advantageous structural embodiment of the locking mechanism consists in that the striker element is embodied as a striker strip disposed spaced apart from the locking plate in the opening direction, and that the counter-striker element grips around the connecting strip or penetrates through it and is widened at the end of the penetrating area in respect to the width of the penetration opening, and that the counter-striker element is sunk in a recess of the door or window frame. With this embodiment, too, it is merely necessary to form or weld a striker element on the inside of the locking plate, which later is in engagement with the counter-striker element which is anchored in the recess.

The locking plate can usefully be embodied as an angled plate in all embodiments, particularly if it is an alarm-triggering locking mechanism in the door lock area. In this case it has been shown to be advantageous if the leg of the locking plate which is parallel with the opening direction has elongated holes extending in the opening direction, wherein holding screws, which engage these elongated holes and are inserted into the door or window frame come to rest against respectively one end edge of the elongated holes after the limited movement of the locking plate in the opening direction. In the course of overcoming the first blocking device it is additionally necessary here to overcome the friction between the screw heads of these screws and the edges of the elongated holes, and when respectively resting against an end edge of the elongated holes, these holding screws generate an additional contribution to the mechanical solidity of the second blocking device. In the simplest embodiment such elongated holes can also exclusively be used as the first and second blocking devices.

Finally, an advantageous structural embodiment also consists in that the locking plate is disposed at least partially under an angled strip embodied as the counter-striker element and anchored on the door or window frame, which has a recess which permits the locking plate to pass through in the opening direction after the holding screws which are used as the first blocking device have been overcome, wherein two striker elements, which grip the angled strip from below at both sides of the recess are disposed on the locking plate. After tearing or ripping out the holding screws used as the first blocking device, the locking plate can be displaced in the opening direction underneath the angled strip until the striker elements come to rest against the angled strip. As the counter-striker element, the latter only now offers an increased resistance to a further opening movement with its entire holding force. This embodiment essentially requires no milling cuts in the door or window frame.

The locking plate is usefully also embodied as an angled plate, wherein the leg of this angled plate not supporting the striker elements essentially has a shape corresponding to the recess in the angled strip and in the original installed state is disposed flush in this recess in order to achieve a flat, continuous exterior contour.

To prevent that under an increased breaking force the locking plate is bent so much that the striker element can slide out of the recess, at least one of the striker elements has a serrated connection with the angled strip which becomes effective in the striker position to prevent a relative movement between the locking plate and the angled strip in the longitudinal direction.

Tear-off wires charged with a current and/or under tension, or magnetically or mechanically triggered electrical switches, which give off an alarm signal in case of a relative movement of the locking plate, are used as alarm-triggering means in an advantageous manner known per se.

Figure 2:
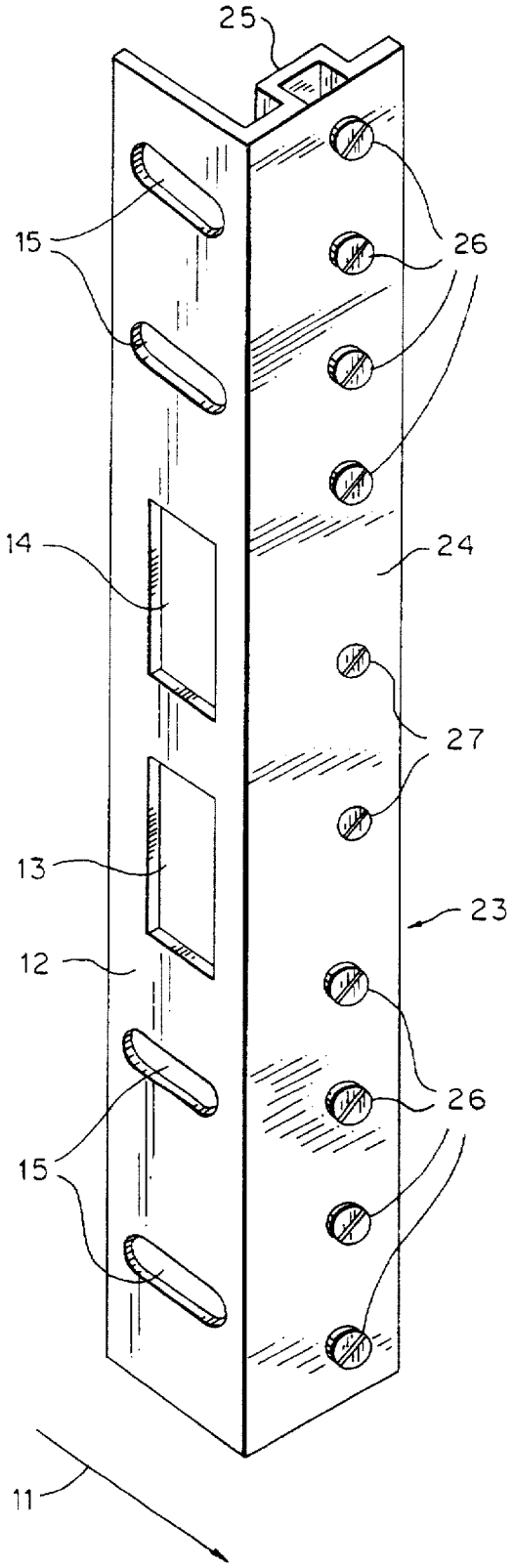
Figure 3:
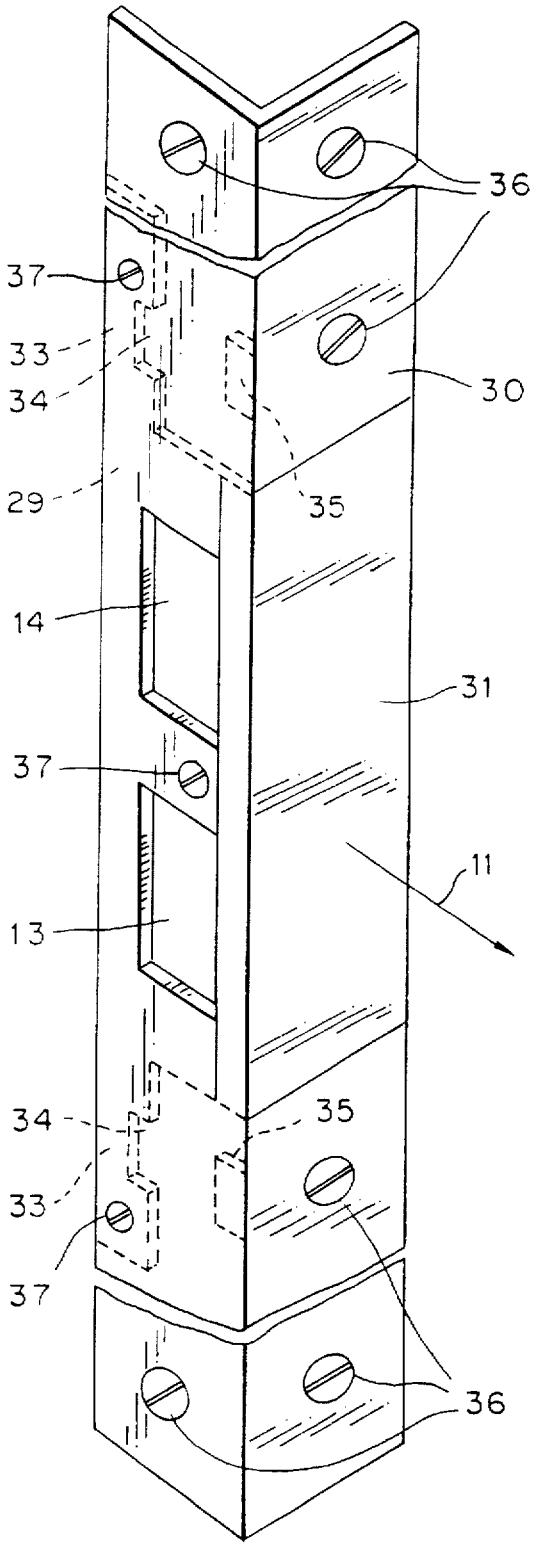
Figure 4:
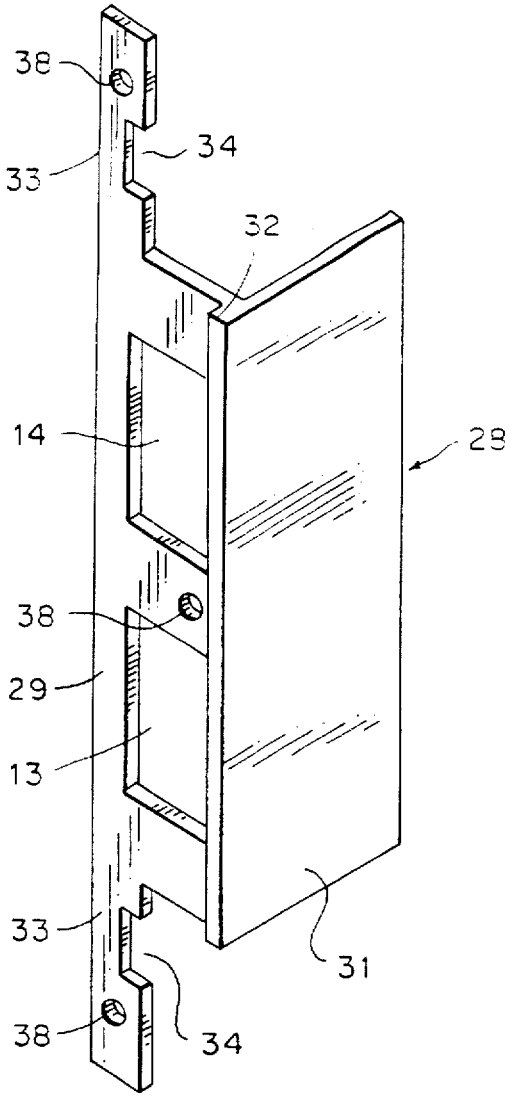
Figure 5:
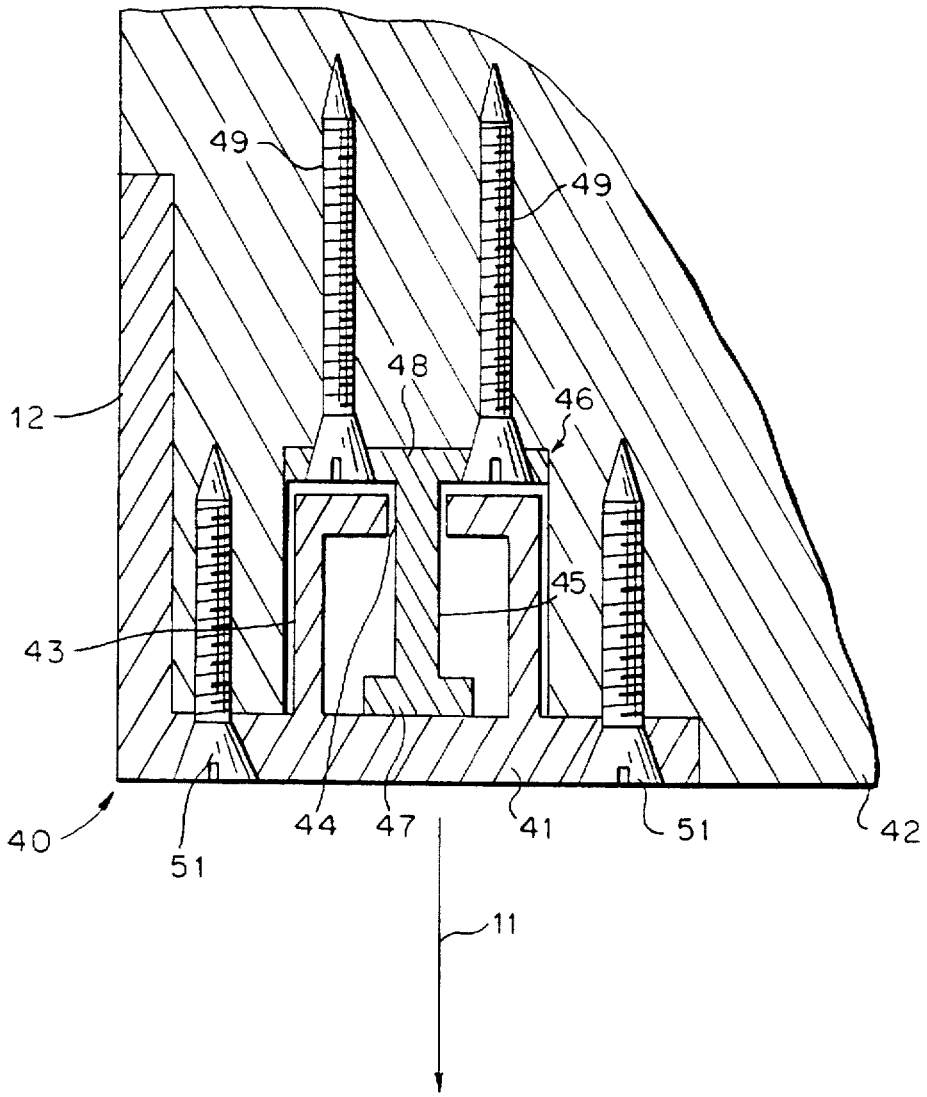
Figure 6:
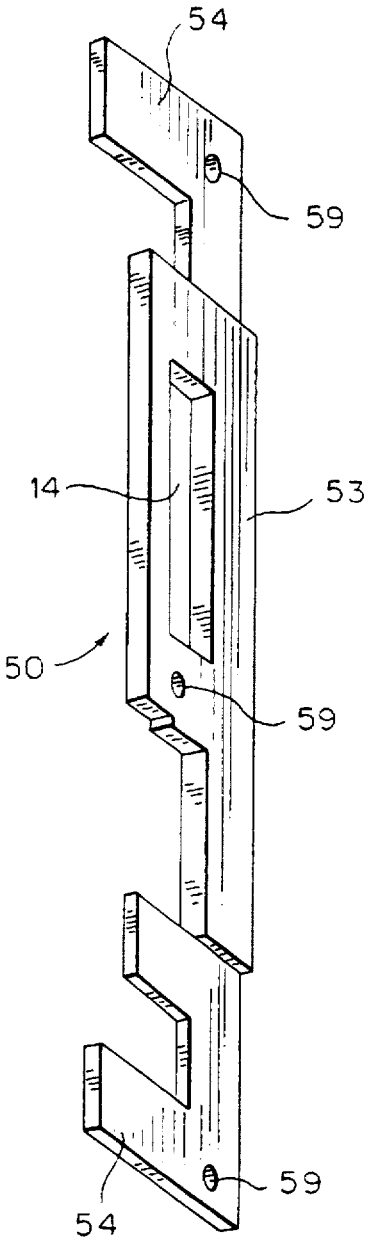
Figure 7:
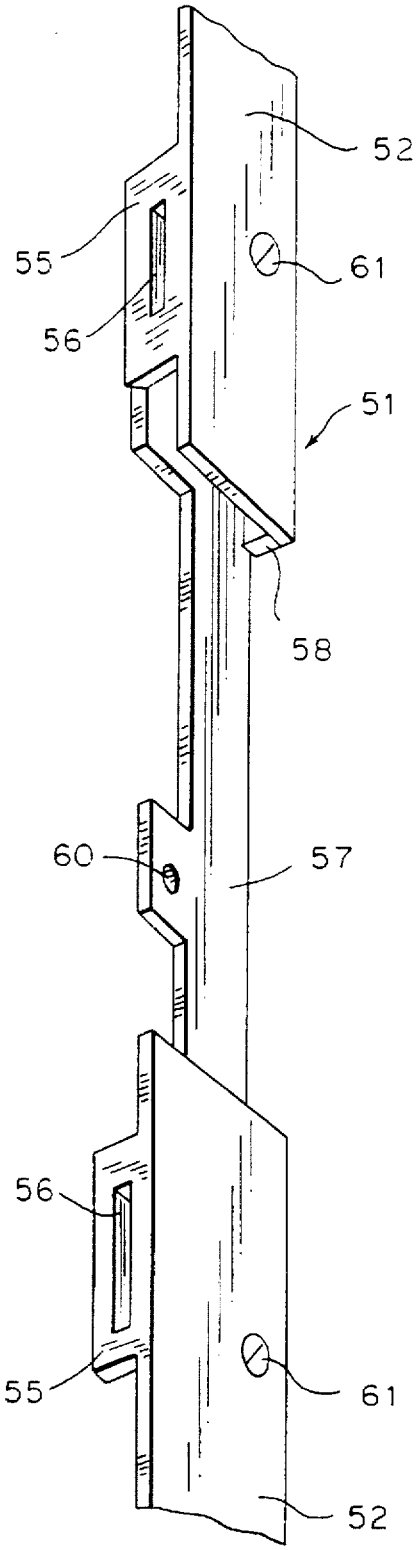
Figure 8:
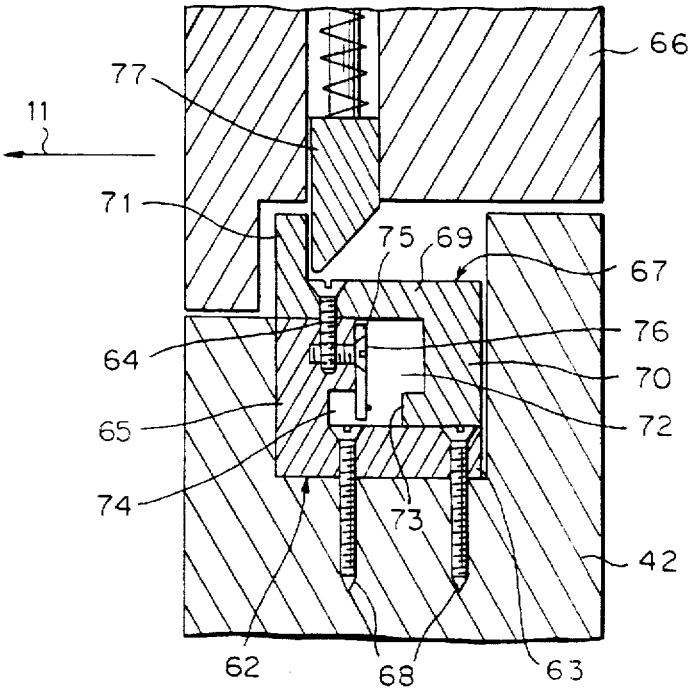
Figure 9:
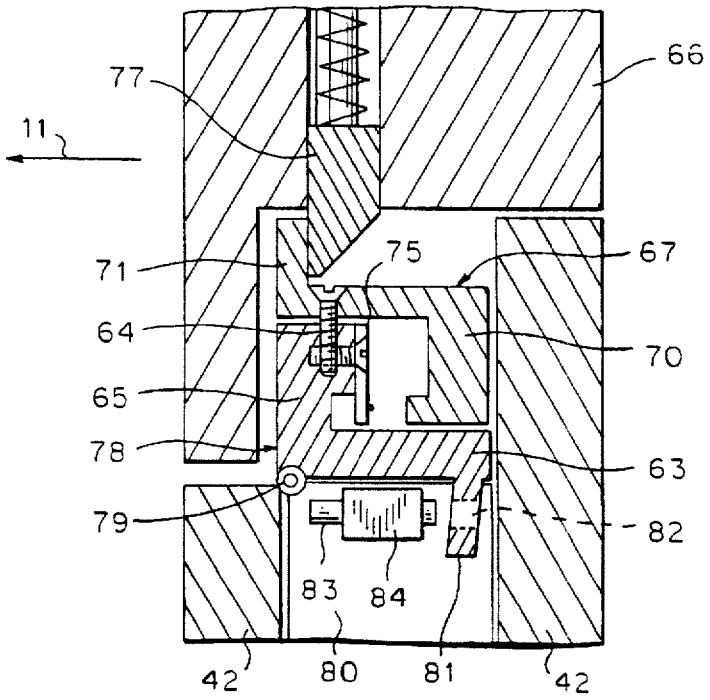

Exemplary embodiments of the invention are represented in the drawings and will be explained in detail in the following description. Shown are in:

FIG. 1, a perspective view of a locking plate as the first exemplary embodiment of the invention, FIG. 2, a perspective view of a further locking plate as the second exemplary embodiment of the invention, FIG. 3, a perspective representation of a locking plate partially disposed underneath an angled strip as the third exemplary embodiment of the invention, FIG. 4, a separate view of the locking plate represented in FIG. 3, FIG. 5, a sectional representation of a further locking plate as the fourth exemplary embodiment of the invention, FIG. 6, a perspective representation of a further locking plate as the fifth exemplary embodiment of the invention, FIG. 7, a holding strip receiving the locking plate shown in FIG. 6, FIG. 8, a sectional representation of a sixth exemplary embodiment of the invention, and FIG. 9, a sectional representation of a seventh exemplary embodiment of the invention.

The locking plate 10, shown in FIG. 1 as the first exemplary embodiment of an alarm-triggering locking mechanism, is embodied as an angled plate of an essentially L-shaped cross section and in the installed state is set into a frame, not shown, of a door or a window. In this case an arrow 11 identifies the opening direction of the not shown door or the not shown window. In a manner known per se, a bolt entry opening 13 and a latch entry opening 14, which are engaged by respectively the latch and the bolt of a door lock, not shown, are disposed in the leg 12, which in the installed state is aligned parallel with the opening direction, of the locking plate 10. One of the two openings can be omitted in case of a window. In addition, four elongated holes 15 are cut into this leg 12 and extend in the opening direction of the arrow 11. Two striker strips 17 of essentially U-shaped cross section are formed or welded on the inside of the second leg 16 of the locking plate 10, disposed at right angles in respect to the first leg 12. Essentially these two striker strips 17 extend in the upper and lower thirds of the linear extension of the locking plate 10, wherein these striker strips 17 form groove-like conduits of an essentially right-angled cross section in the second leg 16. Step-like cut-ins 18 for receiving correspondingly shaped small holding plates 19, used as predetermined breaking elements, are disposed in the area of the longitudinal edges of these groove-like conduits. Respectively four screw holes 20 which, however, cannot be seen in the perspective representation, are cut into these small holding plates 19, and a corresponding hole arrangement is provided at the bottom of the striker strip 17 disposed parallel with the second leg 16.

The small holding plates 19 used as predetermined breaking elements are designed, for example, as plastic plates, wherein a meander-shaped strip conductor 21 has been placed on one of these small holding plates 21, to which two alarm lines 22 are connected. It is of course possible to provide the lower small holding plate 19 also with such a strip conductor 21.

For installation, the locking plate 10 is inserted into a correspondingly shaped recess of a door or window frame and screwed in. In the course of this the small holding plates 19 are inserted into the step-like cut-ins 18, and then screws are screwed through the screw holes 20 and the corresponding screw holes in the striker strip 17 into the door frame or the like. Holding screws, not shown, are correspondingly screwed into the elongated holes 15 in such a way that they come to rest against the end of the respective elongated hole 15 which adjoins the second leg 16.

In the course of a forced break-in attempt into the door or the window, a force is exerted on the locking plate 10 in the direction of the arrow 11. Starting at a defined force effect, the small holding plates 19 break and the locking plate 10 can move in the opening direction until the heads of the holding screws now come to rest against the bottom of the striker strip 17. The remaining holding screws rest against the opposite end of the elongated holes 15. In this case the length of the elongated holes 15 corresponds to the depth of the striker strip 17. The strip conductor 21 is interrupted because of the breaking of the small holding plates 19, and an alarm system, not shown, triggers an alarm in a known manner, which is provided via radio or telephone to a security company manned around the clock.

Although a small gap is now open in the door or the window, the again securely anchored screws offer an increased resistance to a second break-in attempt. The burglar is now delayed, so that the security company or the police are given an opportunity to reach the location of the break-in and to arrest the burglar, possibly before he enters the building.

The small holding plates 19 can of course consist of another material, for example of sheet metal, wherein other known alarm-triggering means can also be employed to trigger an alarm, such as magnetic switches or mechanically triggered switches which register the movement of the striker strip 10 in the opening direction. An electrical conductor used as the alarm wire can also be fixed in place on the frame of the door or window opening or on the striker plate in such a way that it snaps when an attempt to force open or break in is made. It is of course also possible to correspondingly secure other openings, not only door or window openings, with the locking mechanism in accordance with the invention.

A similarly embodied locking plate 23 is represented in FIG. 2 as the second exemplary embodiment, wherein for simplification similar or similarly acting components or elements are provided with the same reference numerals and are not again described. A second modified leg 24 without groove-like conduits is disposed at right angles to a correspondingly embodied first leg 12. A striker strip 25 of a U-shaped cross section embodied similar to the first exemplary embodiment is formed on its back, for example welded to it. Holding screws 26, four arranged in the upper end area and four in the lower end area, of which only the screw heads have been represented, extend through the second leg 24 and the striker strip 25 in such a way that the screw heads are arranged flush in corresponding screw holes of the second leg 24 which have at least the diameter of the screw heads. However, the screw holes, not shown, in the striker strip 25 have a lesser diameter, so that the screw heads cannot penetrate through them. Furthermore, two holding screws 27 for fixing the locking plate 23 in place are provided in the central area, whose screw heads are embodied as flat heads, for example, and hold the second leg 24 on the door or window frame.

In case of the application of force for breaking open the door or the window, first the holding screws 27 are ripped out, which represent a predetermined breaking point or a first blocking device. As in the first exemplary embodiment, the locking plate 23 now can move to a small degree in the opening direction until, on the one hand, the heads of the holding screws 26 rest against the striker strip 25 and the other, not shown, screws came to rest—as in the first exemplary embodiment—in the end area of the elongated holes 15. In the course of the locking plate breaking loose following the ripping out of the holding screws 27, an alarm signal is again triggered by a device known per se. Now the placement of the heads of the holding screws 26 against the striker strip 25 and the placement of the not shown screws against the opposite end area of the elongated holes 15 provide increased resistance to a further break-in attempt which, as with the first exemplary embodiment, delays the burglar.

The number, arrangement and shape of the screws and screw holes is of course not limited to the exemplary embodiment represented.

With the third exemplary embodiment shown in FIGS. 3 and 4 a locking plate 28 is again shaped as an angled plate. In the installed state, the first leg 29 of this locking plate 28 having the bolt entry opening 13 and the latch entry opening 14 is covered by an angled strip 30 of a greater length than the locking plate 28 and provided with a corresponding bolt entry opening 13 and latch entry opening 14, so that in the basic state in accordance with FIG. 3 these openings are respectively aligned with each other. The second leg 31 of the locking plate 28, disposed perpendicularly in respect to the first leg 29, is located flush in a corresponding recess of the angled strip 30 in the basic state in accordance with FIG. 3. The second leg 31 projects past the first leg 29 by an amount corresponding to the sheet metal thickness of the angled strip 30 in order to achieve flush and step-free surfaces. In this case the projecting area 32 can also overlap the first leg 29 by a defined amount, wherein the recess in the angled strip 30 is correspondingly matched.

Starting at the free end area of the first leg 29, striker elements 33 formed in one piece extend in the longitudinal direction towards both sides and are provided on their side facing the second leg 31 with serrated recess 34. Corresponding serrated elements 35 are disposed on the corresponding inner areas of the angled strip 30.

The angled strip 30 is anchored on the frame of a door or a window by means of six holding screws 36 capable of bearing high loads. Three further, weaker holding screws 37 are used as predetermined breaking points and extend through the angled strip 30 and the screw holes 20 of the locking plate 28 arranged underneath in the said frame.

The original installation state is represented in FIG. 3. In case of a forced breaking open of the door, for example by prying, a force in the direction of the arrow 11 occurs. Starting at a defined amount of force, the screws 37 used as predetermined breaking points break or are sheared off. Because of this the locking plate 28 can move relative to the angled strip 30 in the direction of the arrow 11 until the striker elements 33 come to rest against the inner corner area of the angled strip 30 and engage the serrated elements 35 there. To break open the door completely it is now necessary to overcome the stronger holding screws 36, which delays the burglar. The serrations by means of the serration recesses 34 and the serrated elements 35 achieves that the locking plate 28 cannot be bent out of the corresponding opening of the angled strip 30 by the bending of the striker elements 33.

With the fourth exemplary embodiment represented in FIG. 5, a locking plate 40 embodied as an angled plate is shown in a cross-sectional representation. In this case the first leg 12 corresponds to those of the first and second exemplary embodiments. The respective openings, elongated holes and screws have not been shown for simplicity's sake. A striker strip 43 of an essentially U-shaped cross section is formed, for example welded, on the inside of the second leg 41, i.e. in the installed state on the side of the door frame 42, and essentially corresponds to the striker strip 25 of the second exemplary embodiment. A cross bar 45 of a holding strip 46 with a cross section of the type of an asymmetric double-T support extends through a longitudinal slit 44 in the wall of the striker strip 43 extending parallel with the second leg 41. A narrower exterior bar 47 in this case extends in the striker strip 43, while a wider exterior bar 48 is anchored on the door frame 42 by means of holding screws 49. The holding strip 46 is arranged in a groove-like recess 50 of the door frame 42, which is also engaged by the striker strip 43 in the installed state. The second leg 41 is anchored in the door frame 42 by means of holding screws 51 used as predetermined breaking points.

The original installed state is represented in FIG. 5. In case of the exertion of a force, first the holding screws 51 used as predetermined braking points are ripped out, and the locking plate 40 moves in the direction of the arrow 11 until the exterior bar 47 comes to rest against the wall of the connecting strip 43 provided with the longitudinal slit 44. Now it is necessary to overcome the greater strength of the stronger holding screws 49 for breaking in further, which delays the burglar. In addition, he must overcome the holding screws, not shown, extending through the first leg 12, which then rest against an end area of the also not shown longitudinal holes 15.

In a variant of the fourth exemplary embodiment shown in FIG. 5, several individual holding elements can take the place of the holding strip 46, which either have a correspondingly shorter length or which are embodied circular-symmetrically with the same or similar cross sections. For the insertion of the exterior bars 47 into the striker strip 43, the latter can also be provided with widenings of the longitudinal slit 44 at spaced apart locations, which allow the insertion, wherein subsequently locking takes place by a longitudinal displacement.

A variation is furthermore possible in that the cross bar 45 and the exterior bar 47 are fixed in place on the second leg 41, while the striker strip 43 is fixed in place on the exterior bar 48 and is screwed together with the frame.

All exemplary embodiments have in common that the holding screws or small holding plates respectively used as predetermined breaking points must be dimensioned such that they are relatively easily overcome in a break-in attempt, but that they still withstand the stresses of daily use.

The fifth exemplary embodiment, represented in FIG. 6 in connection with FIG. 7, is constructed similar to the third exemplary embodiment shown in FIGS. 3 and 4, and is mainly intended for use in connection with doors employed, for example, in Great Britain or in the USA. Such doors are pivotable as far as the inside of the jamb lining of the door, and the latch or the bolt of the door lock engage the locking plate disposed flat on the inside of the jamb lining of the door. The embodiment shown in FIGS. 6 and 7 is of course also usable in connection with appropriately constructed windows.

In contrast to the third exemplary embodiment, a locking plate 50 of a flat shape is provided here which, in the installed state, is covered by an angle strip 51 which has a greater length than the locking plate 50. The locking plate 50 has a latch entry opening 14 which can also be embodied as a bolt entry opening 13, wherein both openings can also be provided. The first leg 52 of the angled strip 51 which, in the installed state, is arranged parallel with the locking plate 50 has a recess which is engaged by the central, projecting area 53, which also has the latch entry opening 14, in such a way that its exterior surface extends flush with the exterior surface of the first leg 52. The locking plate 50 has angle-shaped striker elements 54 in both of its end areas, which extend behind second leg elements 55 projecting at right angles from the first leg 52. These leg elements 55 have cutouts 56, behind which the angle-shaped striker elements 54 are arranged in such a way that their free legs are pushed through these cutouts 56 when the locking plate 50 is forcibly ripped out of its anchoring.

The partial pieces of the first leg 52 and the second leg elements 55 disposed thereon are connected with each other via a connecting strip 57 which is disposed parallel with the first leg 52 offset in such a way that in the installed state it is arranged on or inside the door frame. In this case the first leg 52 is connected with the connecting strip 57 by means of connecting bars 58.

The locking plate 50 has three screw holes 59, wherein screw holes 60 aligned with it are provided in the connecting strip 57 and the first leg 52, of which only one screw hole 60 in the center area of the connecting strip 57 is arranged on an extension thereof in the perspective representation.

For installation, the locking plate 50 is pushed into or under the angled strip 51 in such a way that the screw holes 59 are aligned with the corresponding screw holes 60 and the projecting central area 53 of the locking plate 50 is arranged in the corresponding cutout of the first leg 51 of the angled strip 51. In this state the arrangement composed of the locking plate 50 and the angled strip 51 is screwed by means of holding screws 61 to the inner surface of the door frame or in an appropriate recess therein. Only the heads of two holding screws 61 are represented in FIG. 7, which in the installed state extend through the two outer screw holes 59 of the locking plate 50. The angled strip 51 is otherwise screwed together with the door frame by means of further stronger holding screws 61, not shown. These stronger holding screws are located, for example, in the two outer areas of the angled strip 51 which are disposed in the cut-off area because of the partial representation in FIG. 7.

If the door (or the window) is forcibly opened, for example jimmied, the holding screws 61 break or rip, and the locking plate 50 is displaced perpendicularly in respect to its longitudinal direction in such a way that the angle-shaped striker elements 54 are pushed through the cutouts 56 until the angle contact is made. Alarm-triggering means are triggered, as already mentioned, when the holding screws 61 are ripped loose or the locking plate 50 is displaced. When the locking plate 50 reaches its striker position on the second leg elements 55, it is now necessary to also overcome the stronger holding screws on the angled strip 51, which delays the burglar.

In a variation of the represented and described exemplary embodiments, it is possible that, instead of a striker element which is rigidly connected with the locking plate, a striker element takes its place, which is connected with a wing of the door or window and which after the locking plate tears away in the opening direction after a limited opening movement comes to rest against a counter-striker element on the door or window frame.

In the sixth exemplary embodiment represented in FIG. 8, a strip-like counter-striker element 62, approximately L-shaped in cross section, has been inserted into a corresponding recess of the door or window wing 62, wherein a holding leg 63 arranged on the bottom of the recess is fixed in place on the door or window wing 42 by means of holding screws 64. A counter-striker leg 65 extending perpendicularly therefrom points toward the door or window wing 66. A locking plate 67 having three legs is fastened with its center leg 69, which extends parallel with the holding leg 63 of the counter-striker element 62, on the counter-striker leg 65 by means holding screws 68. In this case a striker leg 70 extends from one end of the center leg 69 toward the holding leg 63 and rests against it there, while a locking leg 71 extends from the opposite end of the center leg 69 toward the door or window wing 66. A gap 72 is located between the striker leg 70 and the counter-striker leg 65. A protrusion 73 on the striker leg 70 extends to the counter-striker leg 65, which has a corresponding recess 74 on its oppositely located location. A small plastic plate 75 is fixed in place on the counter-striker leg 65 by means of a screw 76 (there may also be several screws) in such a way that the recess 74 is covered. This small plastic plate 75 has alarm wires, not shown for simplicity's sake, whose tearing leads to the triggering of the alarm.

A latch 77 is displaceably guided in the door or window wing 66 toward the locking plate 77 and rests spring-loaded against the locking plate 67 in such a way that it prevents an opening movement of the door or window wing 66 in the opening direction 11 by coming to rest against the locking leg 71.

For opening the door or window wing 66, the latch 77 is retracted by means of an actuating lever, not shown, or an electromagnetic actuation device, not shown, so that it is out of engagement with the locking leg 71 and the door or window wing 66 can be opened. In the case of a door it is possible in a manner known per se to provide a bolt additionally or alternatively. A locking recess, into which the latch 77 or the bolt enter, can take the place of the locking leg 71.

If in the locked state shown, the door or window wing 66 is forcibly moved in the opening direction 11, for example by being jimmied, the holding screws 64 first break off and the locking plate 67 moves in the opening direction 11 until the striker leg 70 of the locking plate 67 comes to rest against the counter-striker leg 65 of the counter-striker element 62. In the process the protrusion 73 engages the recess 74 and the small plastic plate 75 breaks and triggers the alarm. To open the door or window wing 66 further it is now necessary to overcome the considerably greater mechanical resistance because of the stronger anchoring of the counter-striker element 62, which delays the perpetrator in the already described manner.

In the seventh exemplary embodiment represented in FIG. 9, identical or identically acting components have been provided with the same reference numerals and are not again described. A counter-striker element 78, which is changed in respect to FIG. 8, is fastened, pivotable by means of a pivot hinge 79, on a holding element 80 which is inserted into the door or window frame 42 and fixed in place there in a manner not shown, for example by holding screws. In this case the pivot hinge 79 is located, viewed in the opening direction 11, on the respectively outermost connecting place between the counter-striker element 78 and the holding element 80. A protrusion 81 extends in the end area of the holding leg 63 remote from the pivot hinge 79 into a corresponding recess of the holding element 80. This protrusion 81 has a locking recess 82 which can be engaged by a locking bolt 83 of an electromagnetic locking device 84.

A mechanical locking device which can be operated from the inside can also take the place of the electromagnetic locking device 84 in principle, or another known mechanical or electro-magnetic locking device can be provided for preventing a pivot movement of the counter-striker element 78.

In the unlocked state of the locking device 84 a pivot movement of the locking plate 67 connected with the counter-striker element 78 takes place when the door or window wing 66 is opened, so that the latch 77 can pass by the locking leg 71 after a defined pivoting movement. When the door or window wing 66 is closed (this also applies to the embodiment in accordance with FIG. 8), the latch 77 can overcome the locking leg 71, which has pivoted back again into its original position, because of its rear sloping and can again take up the original position.

In the locked position of the electromagnetic locking device 84 the locking bolt 83 engages the locking recess 82 of the protrusion 81, so that the counter-striker element 78 is strongly fixed in place against the holding element 80 and thus on the door or window frame 42. In this state breaking of the holding screws 64 occurs during a forced opening of the door or window wing 66, and the alarm is triggered as with the exemplary embodiment shown in FIG. 8. With the seventh exemplary embodiment shown in FIG. 9 the latch 67 does not require an electrical or manual actuating device in contrast to the sixth exemplary embodiment.

I claim:

1. An alarm-triggering locking plate device for a lock area of a door to be secured or a window to be secured, having a locking plate and a first blocking device for the locking plate (28, 50, 67), which must be overcome by force, the locking plate being provided with at least one striker element (33, 54, 70), the locking plate device having a second blocking device for the locking plate (28, 50, 67), which is harder to overcome by said force, which is embodied as at least one counter-striker element (30, 51, 62) for being anchored in a door or window frame, and with means which trigger an alarm when the first blocking device is overcome, wherein, after the first blocking device has been overcome, the movement of the locking plate (28, 50, 67) in an opening direction (11) of the door or the window is limited by the second blocking device, the locking plate device further having securing screws or bolts whereby the locking plate (28, 50, 67) can be attached directly or indirectly to the door or window frame (42) by means of the securing screws (37, 61, 64) or securing bolts embodied as the first blocking device, the securing screws or bolts having predetermined breaking points, which permit them to be torn, broken or sheared off after a defined exertion of force.

2. The locking plate device in accordance with claim 1, characterized in that the locking plate (28, 50) is disposed at least partially under an angled strip (30, 51) embodied as the counter-striker element and for being anchored on the door or window frame, which has a recess which permits the locking plate (28, 50) to pass through in the opening direction after the screws (37, 61) or bolts which are used as the first blocking device have been overcome, wherein two striker elements (33, 54), which grip the angled strip (30, 51) at both sides of the recess are disposed on the locking plate (28, 50).

3. The locking plate device in accordance with claim 2, characterized in that the locking plate (28) is also embodied as an angled plate, and that a leg (31) of this angled plate (28) not supporting the striker elements (33) essentially has a shape corresponding to the recess in the angled strip (30) and in an installed state is disposed flush in this recess.

4. The locking plate device in accordance with claim 1, characterized in that the locking plate (50) has a flat shape.

5. The locking plate device in accordance with claim 2, characterized in that at least one of the striker elements (33, 54) has a serrated connection (34, 56) with the angled strip (30, 51) which becomes effective at least in a striker position to prevent a relative movement between the locking plate (28, 50) and the angled strip (30, 51) in the opening direction.

6. The locking plate device in accordance with claim 1, characterized in that the locking plate (67) connected with the striker element (70) is attached by means of holding screws (64) or holding bolts embodied as the first blocking device to the counter-striker element (62, 78) which itself can be anchored on the door or window frame (42).

7. The locking plate device in accordance with claim 6, characterized in that the striker element (70) and the counter-striker element (62, 78) have a mutual serration (73, 74).

8. The locking plate device in accordance with claim 6, characterized in that the counter-striker element (62) can be solidly anchored on the door or window frame (42) by means of holding screws (68) or holding bolts.

9. The locking plate device in accordance with claim 6, characterized in that the counter-striker element (78) is pivotably fastened on a holding element (80) which can be solidly anchored on the door or window frame (42), and that an electrically or manually actuable locking device (84) for pivot movement is provided.

10. The locking plate device in accordance with claim 6, characterized in that a catch (77), held by means of a spring force in engagement with a shoulder (71) or a recess of the locking plate (67), or a bolt are provided for attachment on the door or window (66).

11. The locking plate device in accordance with claim 10, characterized in that the catch (77) or the bolt are embodied to be manually or electrically movable out of the engagement position.

12. The locking plate device in accordance with claim 1, characterized in that a small plastic plate (75), which supports an alarm-triggering means and breaks in the course of the movement of the striker element (70) against the counter-striker element (62, 78), triggering the alarm in the process, is disposed between the striker element (70) and the counter-striker element (62, 78).

13. The locking plate device in accordance with claim 1, characterized in that tear-off wires charged with a current and/or under tension, or magnetically or mechanically triggered electrical switches are provided as alarm-triggering means.

* * * * *